US011780650B2

(12) United States Patent
Giansanti et al.

(10) Patent No.: US 11,780,650 B2
(45) Date of Patent: Oct. 10, 2023

(54) CAP AND CARTRIDGE ASSEMBLY

(71) Applicant: NORDSON CORPORATION, Westlake, OH (US)

(72) Inventors: Brent A. Giansanti, Ellington, CT (US); Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 417 days.

(21) Appl. No.: 17/051,805

(22) PCT Filed: May 22, 2019

(86) PCT No.: PCT/US2019/033458
§ 371 (c)(1),
(2) Date: Oct. 30, 2020

(87) PCT Pub. No.: WO2019/226735
PCT Pub. Date: Nov. 28, 2019

(65) Prior Publication Data

US 2021/0237941 A1 Aug. 5, 2021

Related U.S. Application Data

(60) Provisional application No. 62/675,053, filed on May 22, 2018.

(51) Int. Cl.

| | |
|---|---|
| ***B65D 41/06*** | (2006.01) |
| ***B65D 50/04*** | (2006.01) |
| ***B65D 81/32*** | (2006.01) |

(52) U.S. Cl.
CPC ..... *B65D 41/06* (2013.01); *B65D 50/04* (2013.01); *B65D 81/325* (2013.01)

(58) Field of Classification Search
CPC ..... B65D 41/06; B65D 50/04; B65D 81/325
(Continued)

(56) References Cited

U.S. PATENT DOCUMENTS 3,910,442 A * 10/1975 Gargano ..... B65D 41/06 215/221
4,059,198 A 11/1977 Mumford
(Continued)

FOREIGN PATENT DOCUMENTS

CA 2793173 A1 * 1/2013 ..... A61J 1/1412
CN 1845854 A 10/2006
(Continued)

*Primary Examiner* — J. Gregory Pickett
*Assistant Examiner* — Niki M Eloshway
(74) *Attorney, Agent, or Firm* — BakerHostetler

(57) ABSTRACT

A cap for sealing a cartridge includes a cap body, a plug, and a biasing member. The cap body includes a cap wall and an annular wall extending from the cap wall. The annular wall defines a channel within and includes a retention member having a barb, a stop spaced apart from the barb, and a base extending circumferentially about a portion of the annular wall from the barb to the stop. The barb, the stop, and the base define a retention channel. The plug is positioned within the channel of the cap body. The plug includes a plug wall and a plug member extending from the plug wall. The biasing member is positioned within the channel of the cap body between the plug wall and the cap wall. The biasing member is configured to provide a biasing force to bias the cap wall away from the plug wall.

26 Claims, 18 Drawing Sheets

(58) Field of Classification Search
USPC ..... 220/293, 295; 215/223, 332
See application file for complete search history.

(56) References Cited

U.S. PATENT DOCUMENTS

| | | | | | |
|---|---|---|---|---|---|
| 4,102,473 | A * | 7/1978 | Draxler | B01D 46/00 | 220/295 |
| 4,579,238 | A * | 4/1986 | Herr | B65D 41/06 | 215/222 |
| 6,450,352 | B1 | 9/2002 | DeJonge | | |
| 7,694,853 | B2 | 4/2010 | Keller | | |
| 8,074,843 | B2 * | 12/2011 | Keller | B05C 17/00553 | 222/137 |
| 2006/0138139 | A1 * | 6/2006 | Keller | B60K 15/0406 | 220/295 |
| 2007/0090079 | A1 | 4/2007 | Keller | | |
| 2010/0163579 | A1 * | 7/2010 | Keller | B05C 17/00593 | 222/137 |
| 2012/0061343 | A1 | 3/2012 | Habibi-Naini | | |
| 2014/0346133 | A1 | 11/2014 | Habibi-Naini | | |

FOREIGN PATENT DOCUMENTS

| | | | | |
|---|---|---|---|---|
| CN | 101595042 | A | 12/2009 | |
| CN | 102398723 | A | 4/2012 | |
| EP | 0620163 | A1 | 10/1994 | |
| EP | 2444336 | A1 * | 4/2012 | B05C 17/0052 |
| JP | 51-127857 | U | 10/1976 | |
| JP | 54-023053 | U | 2/1979 | |
| JP | 2001-072110 | A | 3/2001 | |
| JP | 2007-504058 | A | 3/2007 | |
| JP | 2012-056635 | A | 3/2012 | |
| KR | 10-2011-0046250 | A | 5/2011 | |
| WO | WO-9718145 | A1 * | 5/1997 | A61C 5/64 |
| WO | WO-2013026716 | A1 * | 2/2013 | B01F 13/0023 |
| WO | WO-2014080836 | A1 * | 5/2014 | B65D 41/0471 |

* cited by examiner

CAP AND CARTRIDGE ASSEMBLY

CROSS-REFERENCE TO RELATED APPLICATIONS

This application is a National Stage Application of International Patent App. No. PCT/US2019/033458, filed May 22, 2019, which claims the benefit of U.S. Provisional Patent App. No. 62/675,053, filed May 22, 2018, the entire disclosures of both of which are hereby incorporated by reference as if set forth in their entirety herein.

TECHNICAL FIELD

This disclosure relates generally to a fluid cartridge assembly, and more particularly, to an assembly for sealing a fluid cartridge with a sealing cap.

BACKGROUND

Sealing a fluid cartridge, such as a syringe, with a sealing cap is generally known in the art. There are different types of fluid cartridge assemblies that include a cap capable of being attached, secured, and removed to and from a fluid cartridge to control fluid from entering and exiting the fluid cartridge.

Examples of sealing cap and cartridge assemblies include twist type connections, barb type connections, snap type connections, or other connections. Twist type connections may include, for example, a threaded connection or a bayonet twist connection between the sealing cap and the fluid cartridge. In twist type connections, the cap can be rotated in opposing directions to attach and to remove the cap to and from the fluid cartridge. With barb type and snap type connections, barbs of the cap attach to flanges of the cartridge. In these conventional cap and cartridge assemblies, sealing caps can be inadvertently removed from the fluid cartridge (e.g. inadvertent child access), which can prematurely leak contents of the fluid cartridge and cause harm to the user or other individuals in proximity to the cap and cartridge assembly.

Therefore, there is a need for an improved sealing cap to prevent the premature leak of contents from the fluid cartridge.

SUMMARY

The present disclosure provides an improved fluid cartridge assembly for securely attaching and removing a sealing cap to and from a fluid cartridge. The sealing cap includes a positive locking feature that is adapted for use with existing fluid cartridges on the market that do not currently have any options for securing/locking sealing caps.

An aspect of the present disclosure provides a cap for sealing a fluid cartridge. The fluid cartridge includes a cartridge body and a flange extending outwardly from the cartridge body. The cartridge body defines a cartridge outlet. The cap comprises a cap body, a plug, and a biasing member. The cap body includes a distal wall (e.g. cap wall) and an annular wall extending from the distal wall in a proximal direction. The annular wall defines a channel within and includes a retention member. The plug is positioned at least partially within the channel of the cap body and is configured to substantially seal the cartridge outlet. The biasing member is configured to provide a biasing force to bias the distal wall in the distal direction. The cap is configured to rotatingly transition between a locked position and an unlocked position. In the locked position the retention member is secured to the flange and the plug member substantially seals the cartridge outlet. The biasing force provided by the biasing member retains the cap in the locked position. In the unlocked position the retention member is not secured to the flange.

Another aspect of the present disclosure provides a fluid cartridge assembly that includes a fluid cartridge and a cap. The fluid cartridge comprises a cartridge body and a flange extending outwardly from said cartridge body. The cap is configured to couple to the fluid cartridge to seal the fluid within.

Another aspect of the present disclosure provides an alternative aspect of a cap for sealing a cartridge containing fluid. The cap includes a cap body, a plug, and a biasing member. The cap body includes a distal wall and an annular wall extending from the distal wall in a proximal direction. The annular wall defines a channel within and includes a retention member that has a barb, a stop spaced apart from the barb, and a base extending circumferentially about a portion of the annular wall from the barb to the stop. The barb, the stop, and the base define a retention channel. The plug is positioned at least partially within the channel of the cap body. The plug includes a plug wall and a plug member extending from the plug wall in the proximal direction. The biasing member is positioned within the channel of the cap body between the plug wall and the distal wall. The biasing member is configured to provide a biasing force to bias the distal wall away from the plug wall.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION

Figure 1:
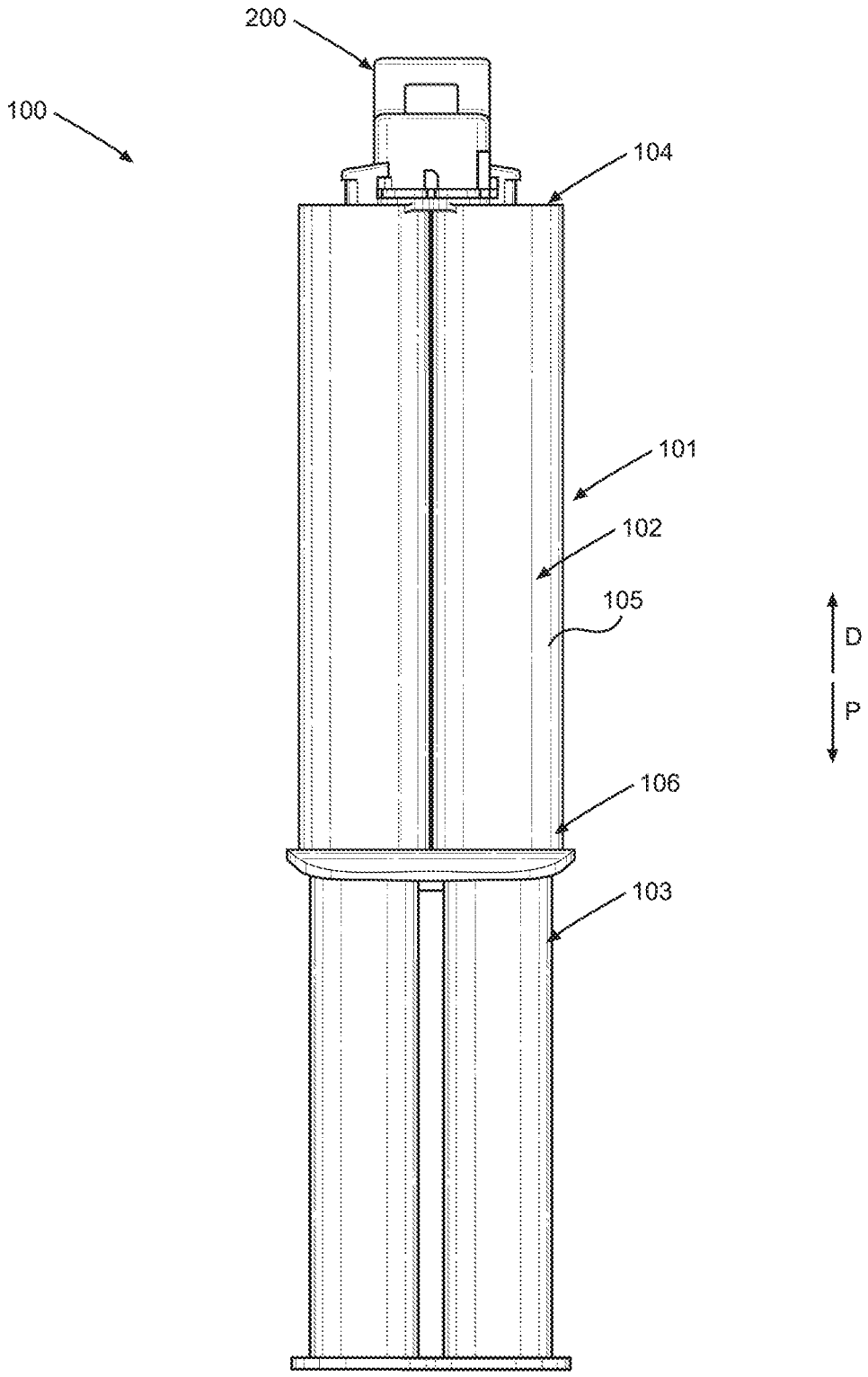
FIG. 1 illustrates aside view of a fluid cartridge assembly, according to an aspect of this disclosure.

The disclosure relates generally to single and dual fluid cartridge assemblies for carrying one or more fluids. The fluid cartridge assemblies include a cap configured to mate with a fluid cartridge in such a way as to reduce the risk of accidental removal of the cap from the fluid cartridge. Accidental removal may occur during transport, child access, or other types of movement of the cartridge assembly. The cap includes a locking mechanism which substantially prevents removal of the cap from the cartridge assembly until the locking mechanism is activated.

Certain terminology is used in the description for convenience only and is not limiting. The words "proximal" and "distal" generally refer to positions or directions toward and away from, respectively, an individual operating a cartridge assembly. The words "inward", "outward", "axial", "radial," and "transverse" designate directions in the drawings to which reference is made. The term "substantially" is intended to mean considerable in extent or largely but not necessarily wholly that which is specified. The terminology includes the above-listed words, derivatives thereof and words of similar import.

FIG. 1 illustrates a side view of a fluid cartridge assembly 100, according to an aspect of this disclosure. The fluid cartridge assembly 100 includes a fluid cartridge 101 configured to contain a fluid to be dispensed and a sealing cap 200 configured to mate with the fluid cartridge 101 to seal the fluid within the fluid cartridge 101. As illustrated in FIG. 1, the sealing cap 200 is coupled to the fluid cartridge 101. The fluid cartridge assembly 100 may also include a piston or plunger 103 configured to slide within a fluid chamber 102 of the fluid cartridge 101. The fluid chamber 102 being defined by a cartridge body 105 of the fluid cartridge 101. To dispense the fluid, the piston 103 moves through the fluid chamber 102 in a distal direction D providing a force to the fluid that causes the fluid to dispense from a distal end 104 of the fluid cartridge 101. The piston 103 may include, for example, a pneumatically or mechanically actuated piston or other actuator configured to dispense fluid.

Figure 2A:
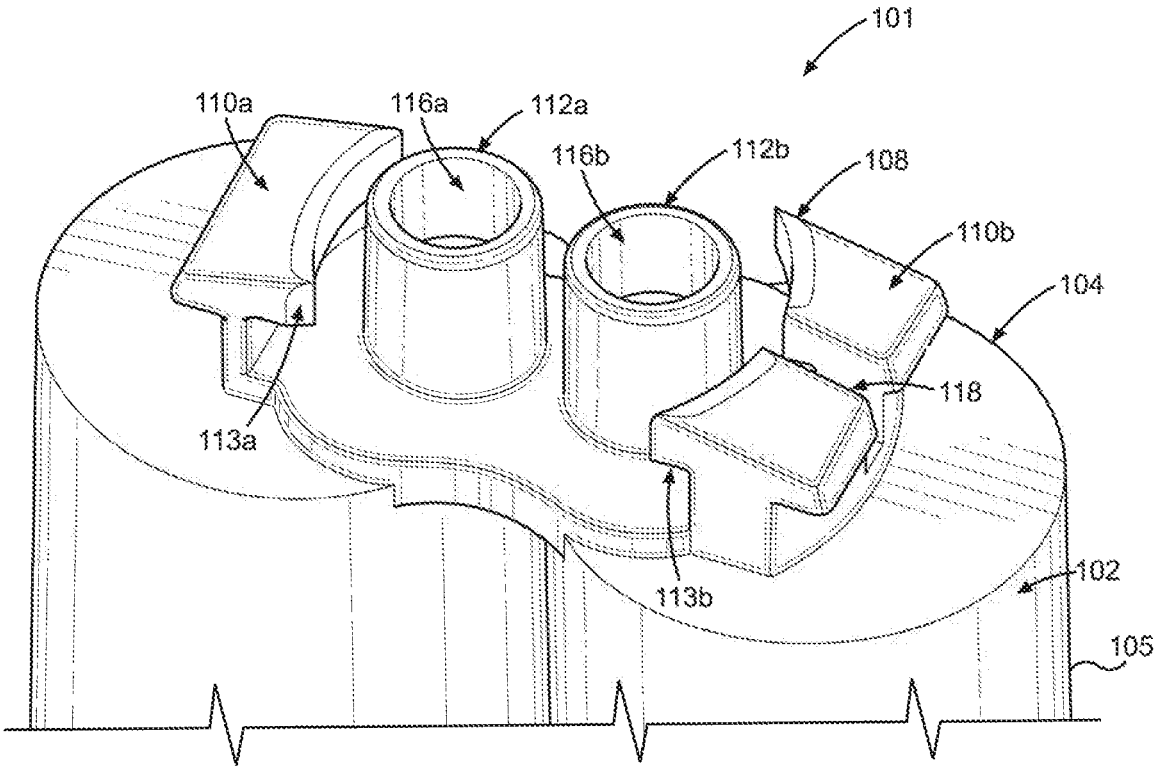
FIG. 2A illustrates a perspective view of a distal end of a fluid cartridge, according to an aspect of this disclosure.

FIG. 2A illustrates a perspective view of the distal end 104 of the fluid cartridge 101, according to an aspect of this disclosure. The fluid cartridge 101 includes the fluid chamber 102 extending from the distal end 104 to a proximal end 106 of the fluid cartridge 101. In an aspect, the fluid cartridge 101 is a dual fluid cartridge (e.g. 2 k cartridge). The proximal end 106 of the fluid cartridge 101 is configured to receive the pistons 103 to push fluid out of the fluid chambers 102 at the distal end 104 of the fluid cartridge 101. The distal end 104 includes an outlet socket 108 for connecting to the cap 200 as described in further detail below.

The outlet socket 108 includes a first flange 110*a* and a second flange 110*b*, a first cartridge outlet annular wall 112*a*, and a second cartridge outlet annular wall 112*b*. The cartridge outlet annular walls 112*a* and 112*b* extend distally from the distal end 104 of the fluid cartridge 101. The cartridge outlet annular walls 112*a* and 112*b* define cartridge outlets 116*a* and 116*b*, respectively. The cartridge outlets 116*a* and 116*b* are in fluid communication with the fluid chamber 102. The cartridge outlet annular walls 112*a* and 112*b* are uninterrupted about the periphery of the cartridge outlets 116*a* and 116*b*. It will be appreciated that the cartridge outlet annular walls 112*a* and 112*b* may include radial projections extending therefrom or recesses formed within.

Each flange 110*a* and 110*b* extends outwardly from the cartridge body 105. Each flange 110*a* and 110*b* extends at least partially in the distal direction D. In an alternative aspect, each flange 110*a* and 110*b* may also extend at least partially radially outward from the cartridge body 105. Each flange 110*a* and 110*b* includes a locking notch flange 113*a* and 113*b*, respectively. Each locking notch flange 113*a* and 113*b* is on a side of the respective flange 110*a* and 110*b* that faces at least partially in a radially inward direction. Each locking notch flange 113*a* and 113*b* is configured to engage corresponding structure of the cap 200 as described in further detail below. Each flange 110*a* and 110*b* may also include a support member attached to the distal end 104 of the cartridge body 105 to provide support to each respective flange 110*a* and 110*b* to minimize deflection and/or movement of each flange 110*a* and 110*b*. Each flange 110*a* and 110*b* may also include an alignment recess 118. In an aspect, only one flange 110*a* and 110*b* includes the alignment recess 118. The alignment recess 118 may extend radially outward from a central longitudinal axis of the fluid cartridge 101. The alignment recess 118 may divide the respective flange 110*a*,110*b* into two flanges spaced apart by the recess 118.

Figure 2B:
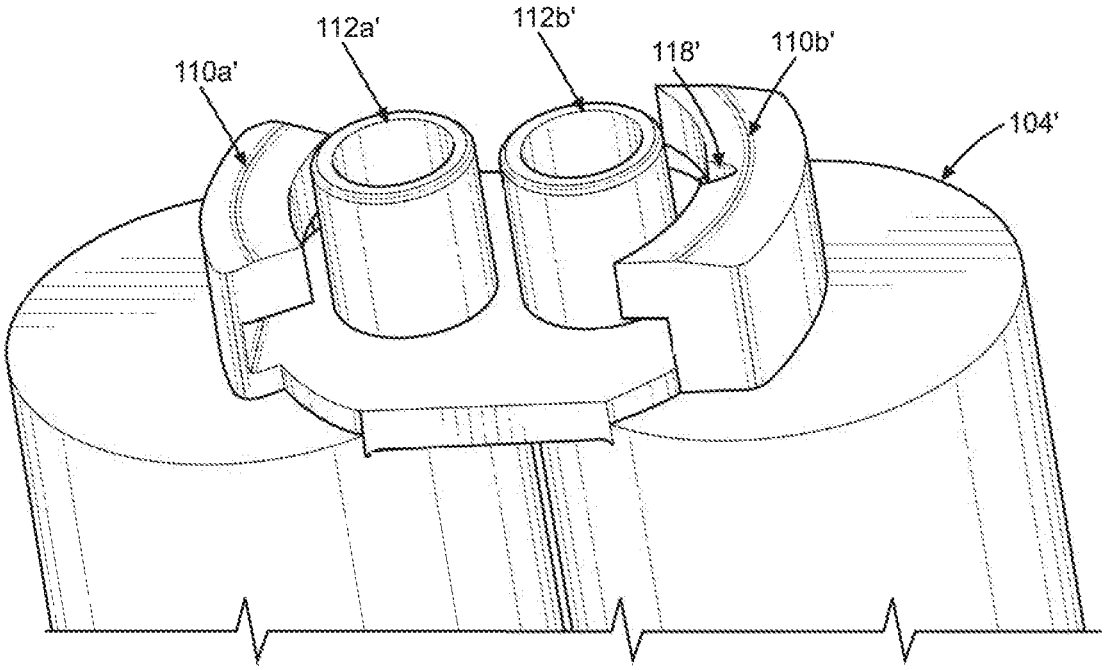
FIG. 2B illustrates a perspective view of an alternative aspect of a distal end of a fluid cartridge, according to an aspect of this disclosure.

FIG. 2B illustrates a perspective view of an alternate aspect of a distal end 104' of the fluid cartridge 101. The distal end 104' has an outlet socket 108' that includes a first flange 110*a*', a second flange 110*b*', a first cartridge outlet annular wall 112*a*', and a second cartridge outlet annular wall 112*b*'. Each flange 110*a*' and 110*b*' may include an alignment recess 118'. In an aspect, only one flange 110*a*' and 110*b*' includes the alignment recess 118'. The alignment recess 118' may extend partially through the respective flange 110*a*',110*b*'.

Figure 3A:
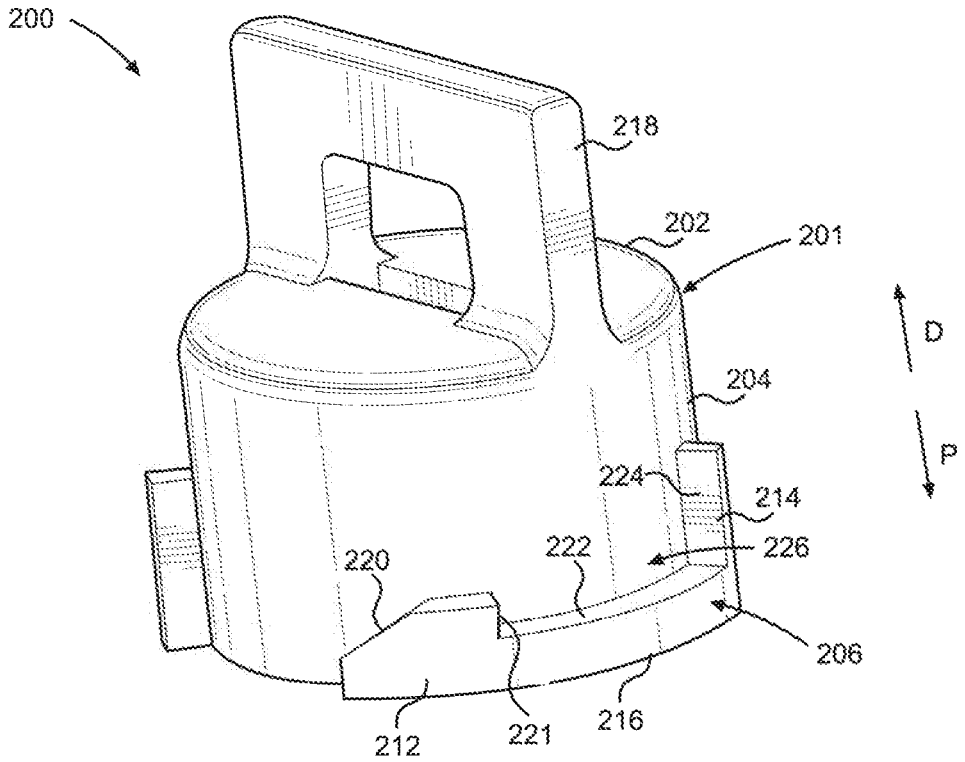
FIG. 3A illustrates a first top perspective view of a sealing cap, according to an aspect of this disclosure.
Figure 3B:
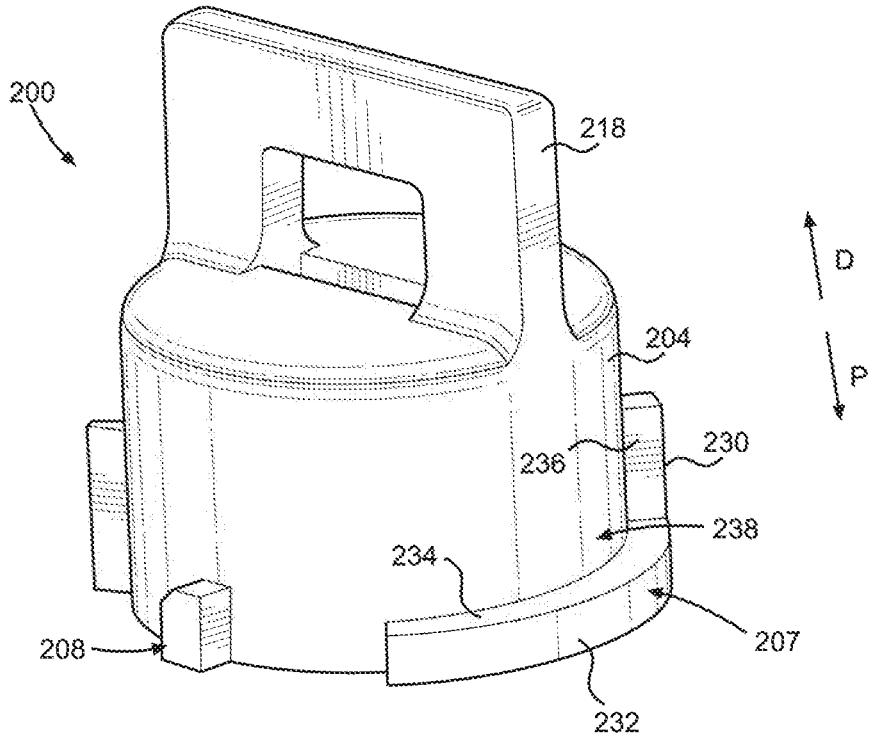
FIG. 3B illustrates a second top perspective view of the sealing cap shown in FIG. 3A, according to an aspect of this disclosure.
Figure 3C:
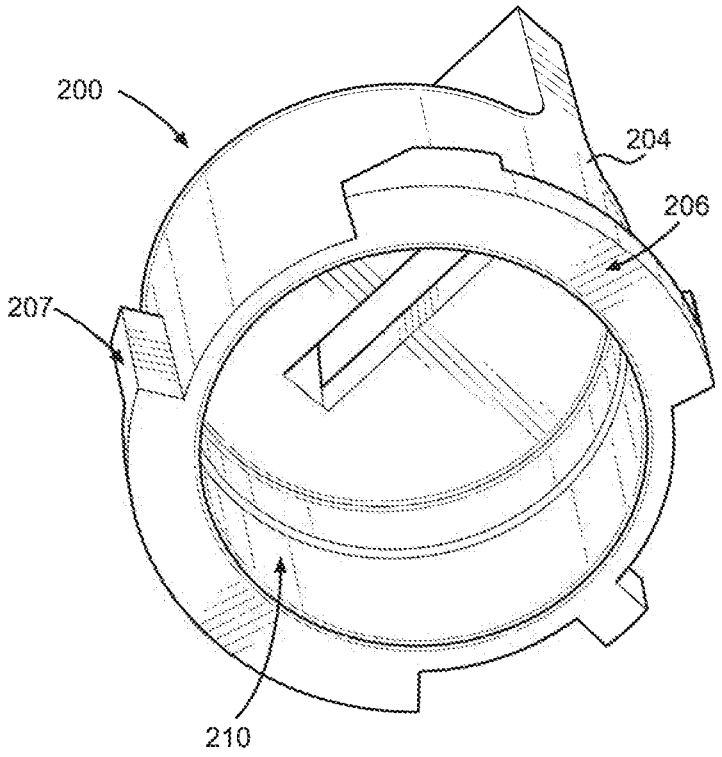
FIG. 3C illustrates a bottom perspective view of the sealing cap shown in FIG. 3A, according to an aspect of this disclosure.

FIGS. 3A through 3C illustrate the sealing cap 200 configured to couple to the outlet socket 108 of the fluid cartridge 101, according to aspects of this disclosure. The sealing cap 200 includes a cap body 201. The cap body 201 includes a closed distal wall 202 (e.g. cap wall), a cap annular wall 204, a first retention member 206, a second retention member 207, and a handle 218 for gripping and rotating the cap body 201. In an aspect, the closed distal wall 202, the cap annular wall 204, the first retention member 206, and the handle 218 form a single unitary cap body 201.

The cap annular wall 204 extends from the closed distal wall 202 in the proximal direction P, and defines a substantially cylindrical channel 210 with a retention bead 211. The cap annular wall 204 includes an alignment protrusion 208 extending radially outward from an outer surface. The alignment protrusion 208 is configured to align with the alignment recess 118 to assist in the alignment of the sealing cap 200 with the fluid cartridge 101. In an aspect, the alignment protrusion 208 is further configured to allow the attachment of the sealing cap 200 on only one flange 110*a* or 110*b* of the fluid cartridge 101. In alternative aspects, there may be a single protrusion extending from the cap annular wall 204, or there may be two or more protrusions extending from the cap annular wall 204. Preferably, the number of alignment protrusions 208 extending from the cap annular wall 204 is the same as the number of alignment recesses 118 on the flanges 110*a* and $110_b$.

Figure 3D:
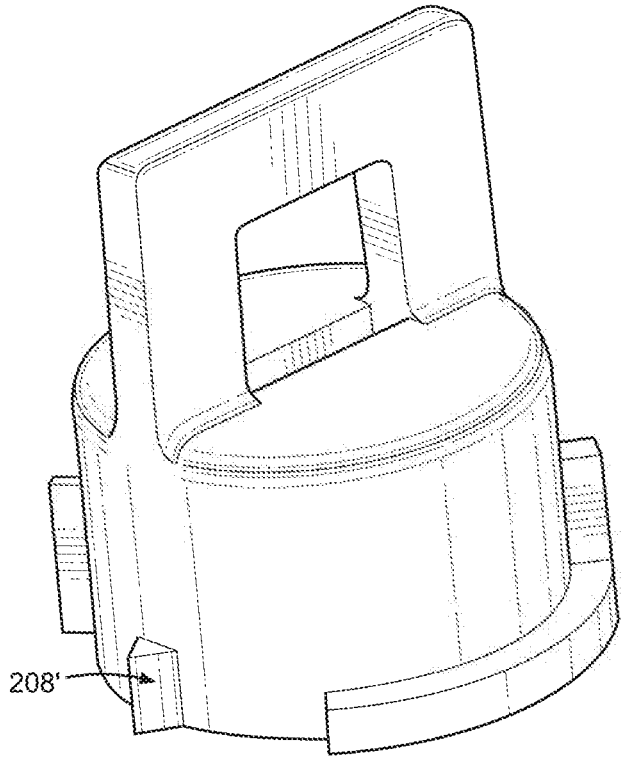
FIG. 3D illustrates atop perspective view of an alternative aspect of a sealing cap, according to an aspect of this disclosure.

FIG. 3D illustrates an alternative aspect of a sealing cap that includes an alignment protrusion 208'. The alignment protrusion 208' has a triangular or pyramidal shape. The alignment protrusion 208' functions similarly to the alignment protrusion 208 described above. The alignment protrusion 208' is configured to align with the alignment recess 118' to assist in the alignment of the sealing cap 200 with the fluid cartridge 101. It will be appreciated that the shapes of the alignment protrusions 208, 208' may include, for example, square shapes, rectangular shapes, curved or rounded shapes, trapezoidal shapes, or other shapes for aligning the cap 200 with the cartridge 101.

The first retention member 206 includes a barb 212, a stop 214 spaced apart from the barb 212, and a base 216 that extends circumferentially about the cap annular wall 204 from the barb 212 to the stop 214. In an aspect, the first retention member 206 is disposed on an outer surface of the cap annular wall 204, and extends from the proximal end of the cap annular wall 204. In a further aspect, proximal ends of the barb 212, the stop 214, and the base 216 are substantially flush with the proximal end of the cap annular wall 204.

The barb 212 includes a first barb edge 220 that is angled relative to the proximal end of the cap annular wall 204, and a second barb edge 221. The base 216 includes a base edge 222 that is substantially parallel to the proximal end of the cap annular wall 204. The stop 214 includes a stop edge 224. The second barb edge 221, the base edge 222, and the stop edge 224 define a first retention channel 226. A circumferential length of the first retention channel 226 may depend on a circumferential length of the locking notch flange 113*a* of the first flange 110*a*, as further described below. In an aspect the second barb edge 221 and the stop edge 224 are substantially perpendicular to the proximal end of the cap annular wall 204.

The second retention member 207 includes a stop 230 and a base 232 that extends circumferentially about the cap annular wall 204 from the stop 230. In an aspect, the second retention member 207 is disposed on the outer surface of the cap annular wall 204, and extends from the proximal end of the cap annular wall 204. In a further aspect, proximal ends of the stop 230, and the base 232 are substantially flush with the proximal end of the cap annular wall 204.

The base 232 includes a base edge 234 that is substantially parallel to the proximal end of the cap annular wall 204. The stop 230 includes a stop edge 236. The base edge 234 and the stop edge 236 define a second retention channel 238. A circumferential length of the second retention channel 238 may depend on a circumferential length of the locking notch flange 113*b* of the flange 110*b*, as further described below. In an aspect, the stop edge 236 is substantially perpendicular to the proximal end of the cap annular wall 204. It will be appreciated that in alternate aspects, the cap body 201 may include only the first retention member 206, two first retention members 206, or other configurations based on the disclosure of this specification.

Figure 4:
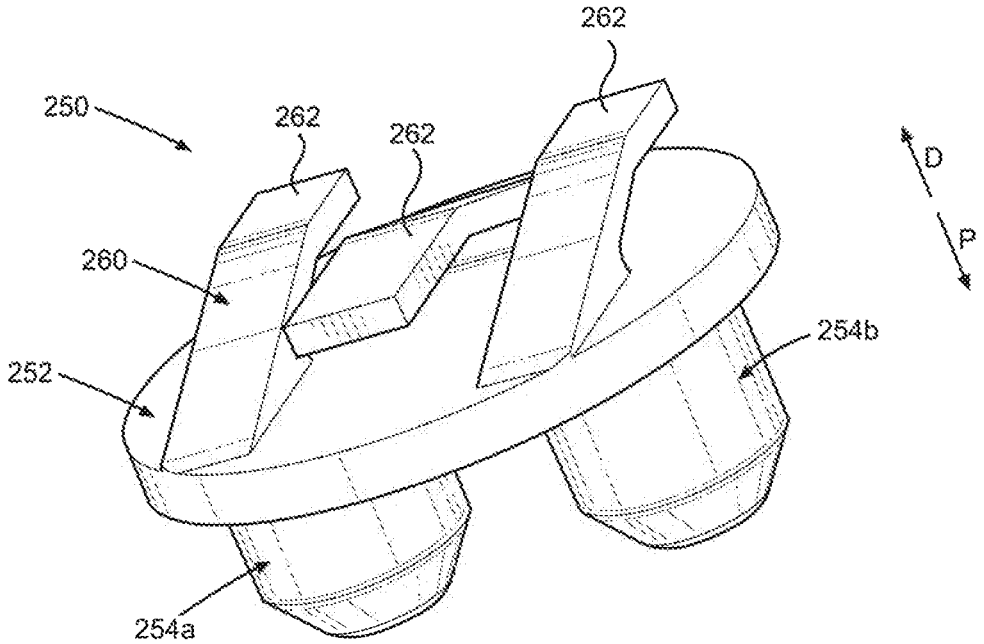
FIG. 4 illustrates a perspective view of a plug, according to an aspect of this disclosure.

FIG. 4 illustrates a perspective view of a plug 250, according to an aspect of this disclosure. The sealing cap 200 includes the plug 250. The plug 250 is configured to be positioned at least partially within the channel 210 of the cap body 201. The plug 250 includes a plug wall 252 and plug members 254*a* and 254*b* that extend from the plug wall 252 in the proximal direction P. The plug members 254*a* and 254*b* are configured to be positioned within the cartridge outlets 116*a* and 116*b* of the fluid cartridge 101, such that fluid flow through the cartridge outlets 116*a* and 116*b* from the fluid chambers 102 is substantially prevented. In an aspect, each of the plug members 254*a* and 254*b* form substantially solid cylindrical members.

The plug 250 further includes a biasing member 260. The biasing member 260 is formed on a distal side of the plug wall 252 such that the plug 250 and the biasing member 260 form a single component. In an alternative aspect, the biasing member 260 may be a separate and distinct component such that the plug 250 and the biasing member 260 are two separate and distinct components. In an aspect, the biasing member 260 is a separate and distinct spring. The biasing member 260 includes resilient spring arms 262. The resilient spring arms 262 comprise a resilient material capable of recoiling or springing back into shape after bending, stretching, or being compressed. In an aspect, the biasing member 260 includes three (3) resilient spring arms 262. It will be appreciated, that fewer or more resilient spring arms 262 may compose the biasing member 260 based on the disclosure of this specification.

The plug 250 is configured to be positioned at least partially within the channel 210 of the cap body 201 such that the biasing member 260 abuts against the distal wall 202 of the cap body 201. The plug wall 252 is configured to be slidable within the channel 210 so that when the plug 250 is compressed and recoiled against the distal wall 202 the plug wall 252 moves distally and proximally, respectively.

Figure 5:
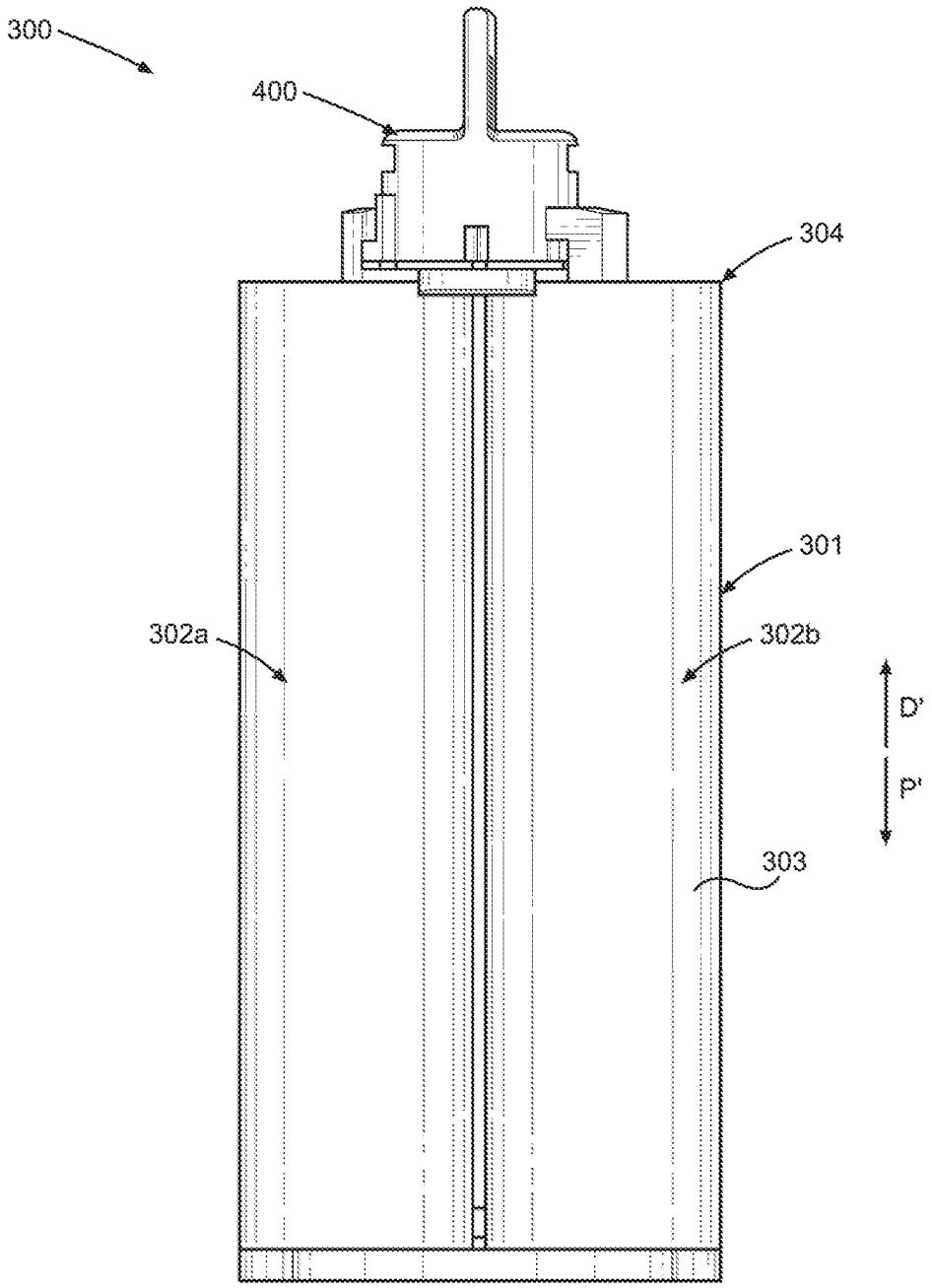
FIG. 5 illustrates a side view of an alternate aspect of a fluid cartridge assembly.
Figure 6A:
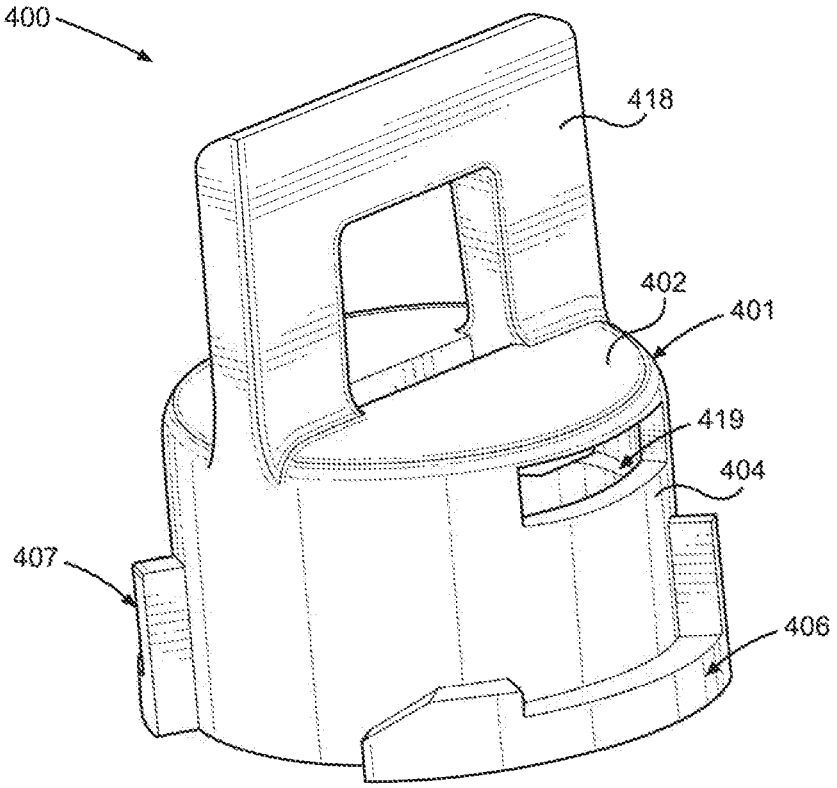
FIG. 6A illustrates a top perspective view of an alternate aspect of a sealing cap.
Figure 6B:
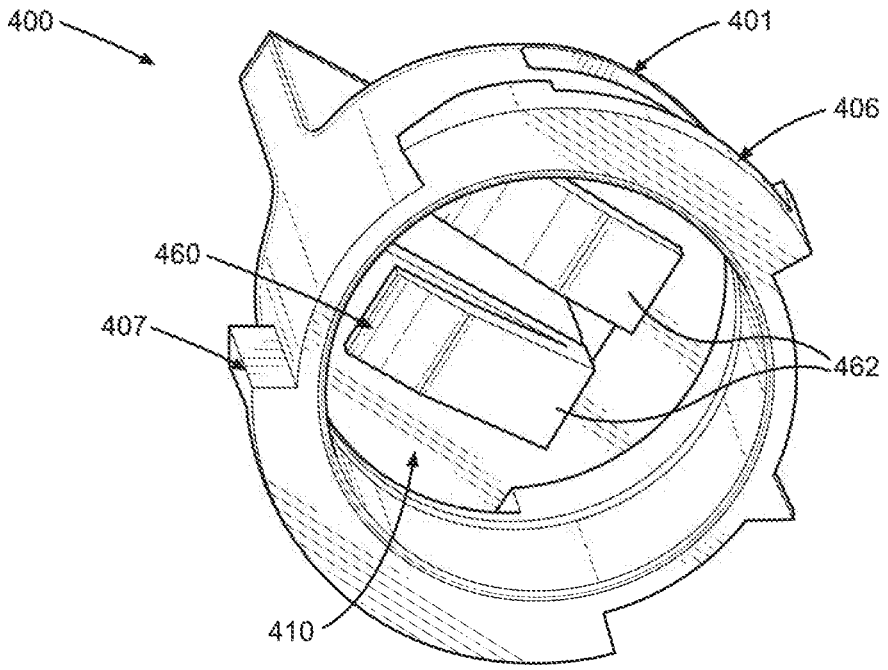
FIG. 6B illustrates a bottom perspective view of the sealing cap shown in FIG. 6A.
Figure 7:
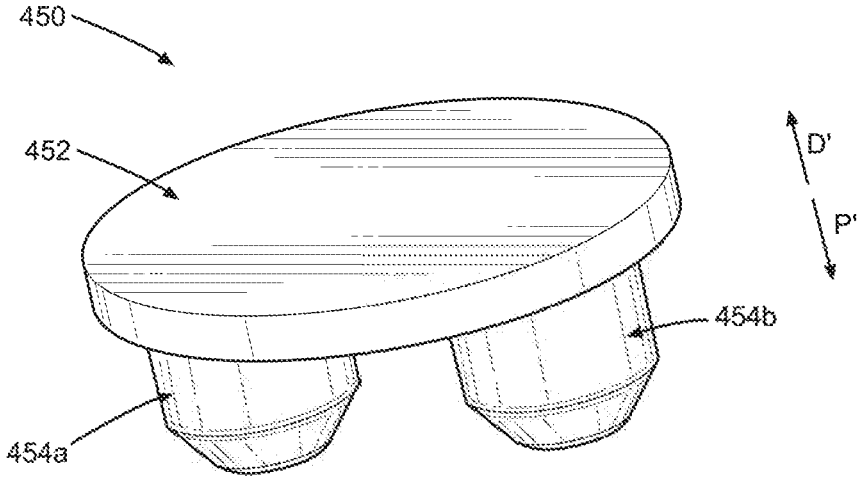
FIG. 7 illustrates a perspective view of an alternate aspect of a plug.

FIGS. 5 through 7 illustrate an alternate embodiment of a fluid cartridge assembly 300. Portions of the embodiment disclosed in FIGS. 5 through 7 are similar to aspects described above in FIGS. 1 through 4 and those portions function similarly to those described above. The fluid cartridge assembly 300 is a dual fluid cartridge assembly that includes a dual fluid cartridge 301 (e.g. 2 k cartridge) and a sealing cap 400. The dual fluid cartridge 301 is configured to contain two fluids to be dispensed and the sealing cap 400 is configured to mate with the dual fluid cartridge 301 to seal the fluids within the fluid cartridge 301.

The dual fluid cartridge 301 includes fluid chamber 302*a* and 302*b* adjacent to one another for containing two fluids to be mixed together before dispensing. Although the two fluid chambers 302*a* and 302*b* are shown with similar sizes in FIG. 5, it will be appreciated that the fluid chambers 302*a* and 302*b* may be resized relative to one another in other aspects consistent with this disclosure. The fluid chambers 302*a* and 302*b* are defined by a body 303 of the fluid cartridge 301. In alternative aspects, the body 303 may include more fluid chambers without departing from this disclosure. A distal end 304 of the fluid cartridge 301 is configured substantially similarly to the distal end 104 of the fluid cartridge 101.

FIGS. 6A and 6B illustrate the sealing cap 400 configured to couple to the distal end 304 of the fluid cartridge 301, according to aspects of this disclosure. The sealing cap 400 includes a cap body 401. The cap body 401 includes a closed distal wall 402, a cap annular wall 404, a first retention member 406, a second retention member 407, and a handle 418 for gripping and rotating the cap body 401. The closed distal wall 402, the cap annular wall 404, the first retention member 406, the second retention member 407, and the handle 418 may be configured substantially similarly as the closed distal wall 202, the cap annular wall 204, the first retention member 206, the second retention member 207, and the handle 218 of the cap body 201, respectively, as described above.

The closed distal wall 402 includes a biasing member 460. The biasing member 460 is formed on a proximal side of the distal wall 402 such that the cap body 401 and the biasing member 460 form a single component. The biasing member 460 includes resilient spring arms 462. The resilient spring arms 462 may be configured substantially similarly to the resilient spring arms 262 of the biasing member 260 as described above.

The cap annular wall 404 defines a substantially cylindrical channel 410, and includes an access window 419 formed within. The access window 419 enables an operator to see through the cap annular wall 404 into the channel 410.

FIG. 7 illustrates a perspective view of a plug 450, according to an aspect of this disclosure. The sealing cap 400 includes the plug 450. The plug 450 is configured to be positioned at least partially within the channel 410 of the cap body 401 formed by the cap annular wall 404. The plug 450 includes a plug wall 452 and plug members 454*a* and 454*b* that extend from the plug wall 452 in the proximal direction P'. A distal side of the plug wall 452 is configured to abut against the biasing member 260 formed on the cap body 401 when the plug 450 is positioned within the channel 410. The plug members 454*a* and 454*b* are configured to be positioned within cartridge outlets defined by the fluid cartridge 101, such that fluid flow through the cartridge outlets from the fluid chambers 102 is substantially prevented. In an aspect, each of the plug members 454*a* and 454*b* form substantially solid cylindrical members.

Figure 8:
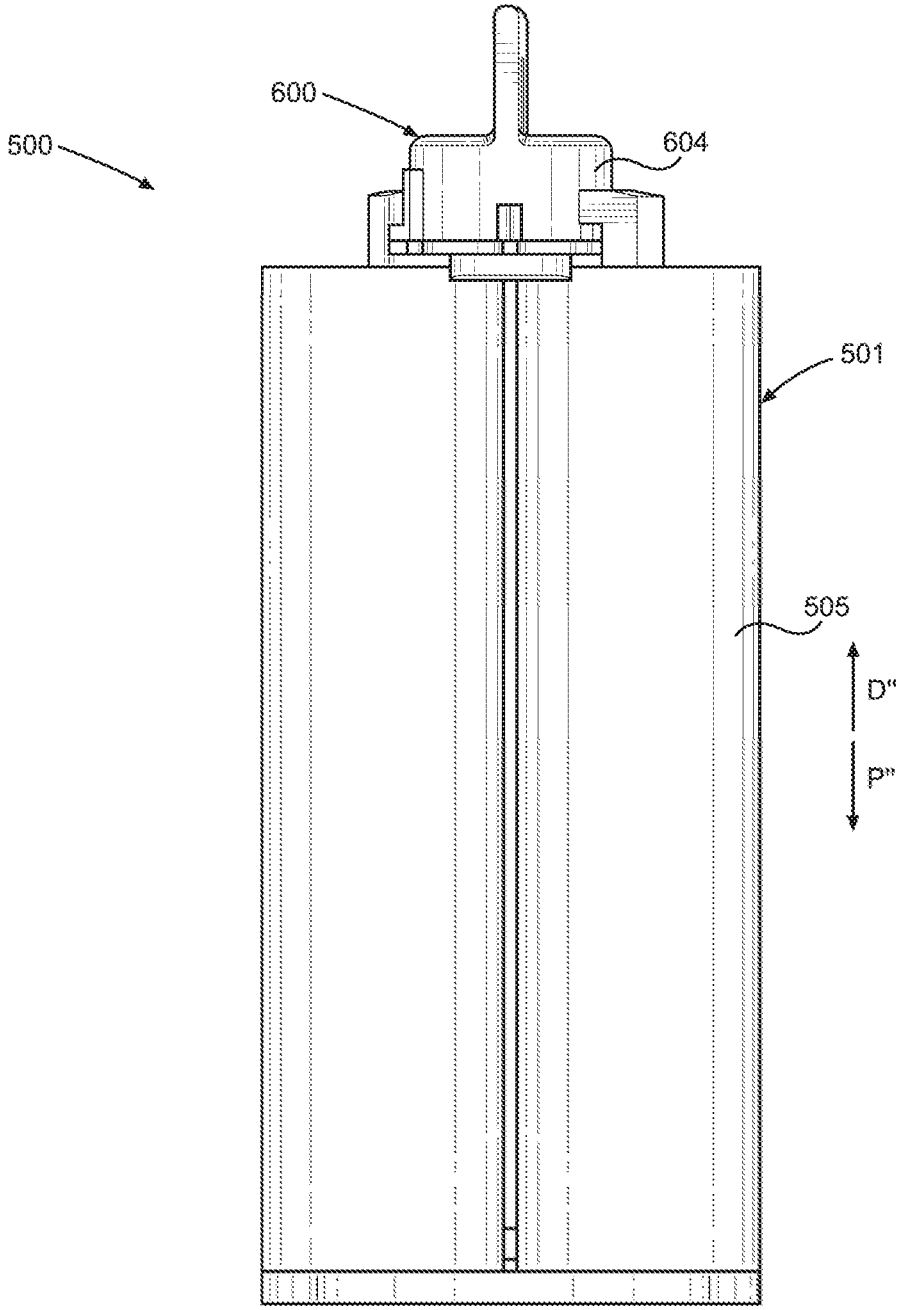
FIG. 8 illustrates a side view of another alternate aspect of a fluid cartridge assembly.
Figure 9:
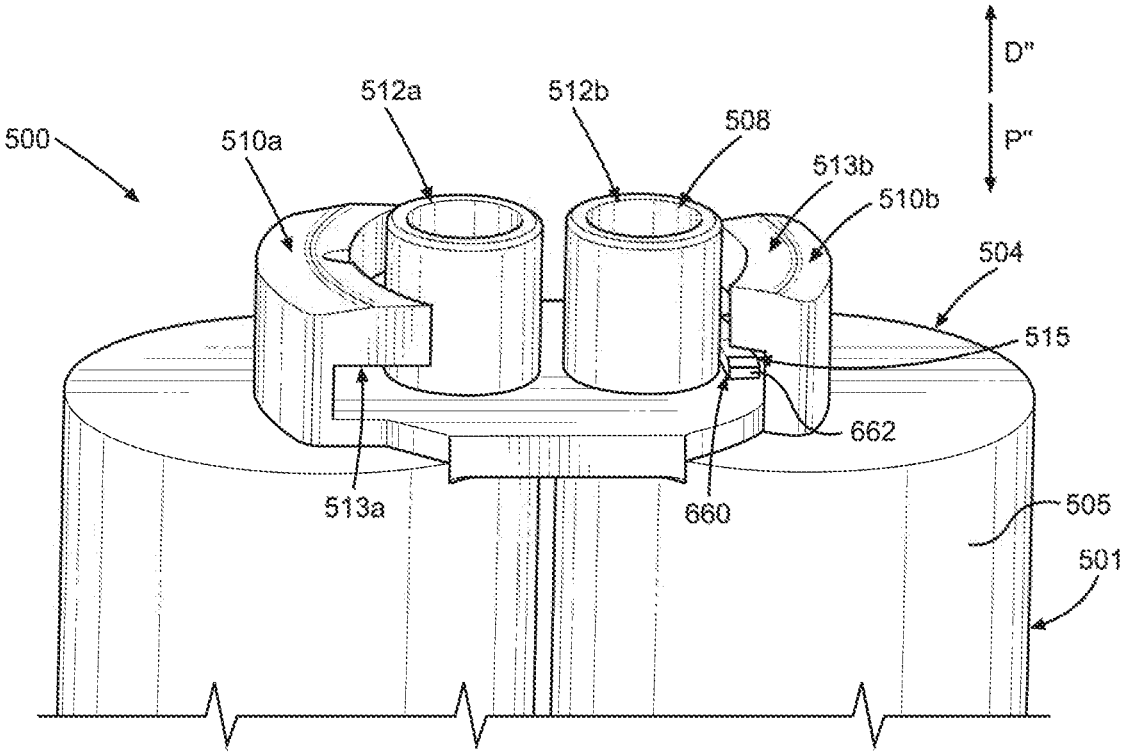
FIG. 9 illustrates a perspective view of a distal end of an alternate aspect of a fluid cartridge.
Figure 10:
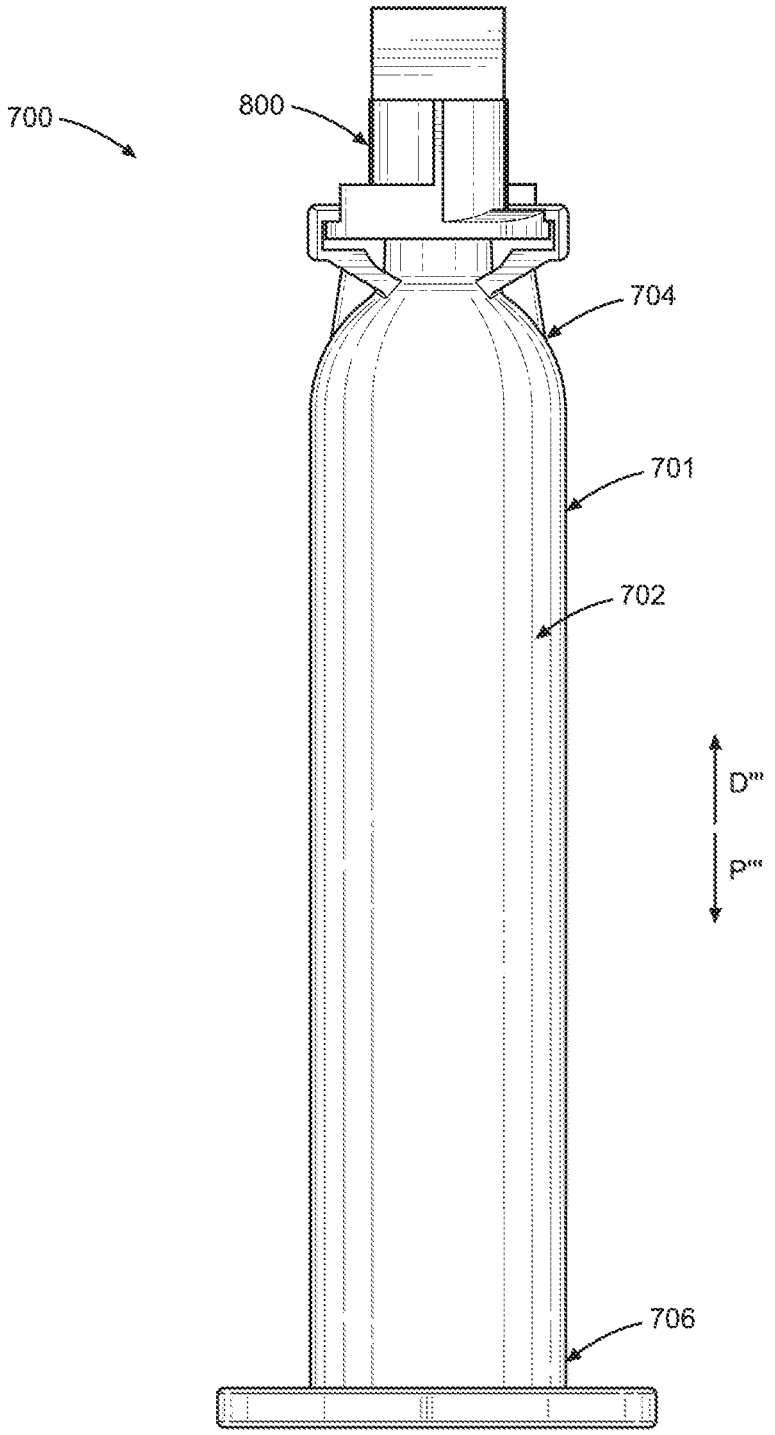
FIG. 10 illustrates aside view of another alternate aspect of a fluid cartridge assembly.

FIGS. 8 and 9 illustrate an alternate embodiment of a fluid cartridge assembly 500. Portions of the embodiment disclosed in FIGS. 8 and 9 are similar to aspects described above in FIGS. 1 through 7 related to the fluid cartridge assemblies 100 and 300, and those portions function similarly to those described above. The fluid cartridge assembly 300 is a dual fluid cartridge assembly that includes a dual fluid cartridge 501 (e.g. 2 k cartridge) and a sealing cap 600. The sealing cap 600 may be configured substantially similarly as the sealing caps 200 and 400 as described above.

A distal end 504 of the fluid cartridge 501 includes an outlet socket 508 for connecting to the sealing cap 600. The outlet socket 508 includes a first flange 510*a*, a second flange 510*b*, and first and second cartridge outlet annular walls 512*a* and 512*b*. The cartridge outlet annular walls 512*a* and 512*b* may be configured substantially similarly as the cartridge outlet annular walls 112*a* and 112*b* of the outlet socket 108 of the fluid cartridge 101.

Each flange 510*a* and 510*b* extends outwardly from a cartridge body 505. Each flange 510*a* and 510*b* extends at least partially in a distal direction D". Each flange 510*a* and 510*b* includes a locking notch 513*a* and 513*b*, respectively. Each locking notch 513*a* and 513*b* is on a side of the respective flange 510*a* and 510*b* that faces at least partially in a radially inward direction. Each flange 510*a* and 510*b* is configured to receive corresponding structure of the sealing cap 600.

The second flange 510*b* and the corresponding locking notch 513*b* form a flange channel 515. The flange channel 515 extends circumferentially about an inner surface of the second flange 510*b* and corresponding locking notch 513*b*. The outlet socket 508 further includes a biasing member 660. The biasing member 660 is formed on a distal side of the distal end 504 of the fluid cartridge 501 such that the fluid cartridge 501 and the biasing member 660 form a single component. The biasing member 660 includes a resilient spring arm 662. The resilient spring arm 662 is positioned within the flange channel 515 and extends from the fluid cartridge 501 in the distal direction D". In an aspect, the resilient spring arm 662 extends at least partially circumferentially within the flange channel 515, such that the resilient spring arm 662 is substantially parallel to the inner surface of the second flange 510*b* and corresponding locking notch 513*b*. In alternative aspects, the resilient spring arm 662 may include one or more arms that are configured substantially similarly to the resilient spring arms 262 and 462 of the biasing member 260 and 460, as described above. It will be appreciated that the fluid cartridge 501 may include a second biasing member (not shown) configured substantially similarly to the biasing member 660, and positioned within a flange channel formed by the first flange 510*a* and the corresponding locking notch 513*a*.

The biasing member 660 is configured to abut against a proximal end of a cap annular wall 604 of the sealing cap 600 when the sealing cap 600 is coupled to the fluid cartridge 501. The biasing member 660 provides a force to the cap annular wall 604 of the sealing cap 600 to bias the cap annular wall 604 in the distal direction D".

FIGS. 10 through 13 illustrate another alternate embodiment of a fluid cartridge assembly 700. Portions of the embodiment disclosed in FIGS. 10 through 13 are similar to aspects described above in FIGS. 1 through 9 related to the fluid cartridge assemblies 100, 300, and 500, and those portions function similarly to those described above. The fluid cartridge assembly 700 includes a single fluid cartridge 701 (e.g. 1 k cartridge) and a sealing cap 800. The fluid cartridge 701 includes a fluid chamber 702 extending from a distal end 704 to a proximal end 706 of the fluid cartridge 701. The proximal end 706 of the fluid cartridge 701 is configured to receive a piston or plunger to push fluid out of the fluid chamber 702 at the distal end 704 of the fluid cartridge 701. The distal end 704 includes an outlet socket 708 for connecting to the sealing cap 800.

Figure 11:
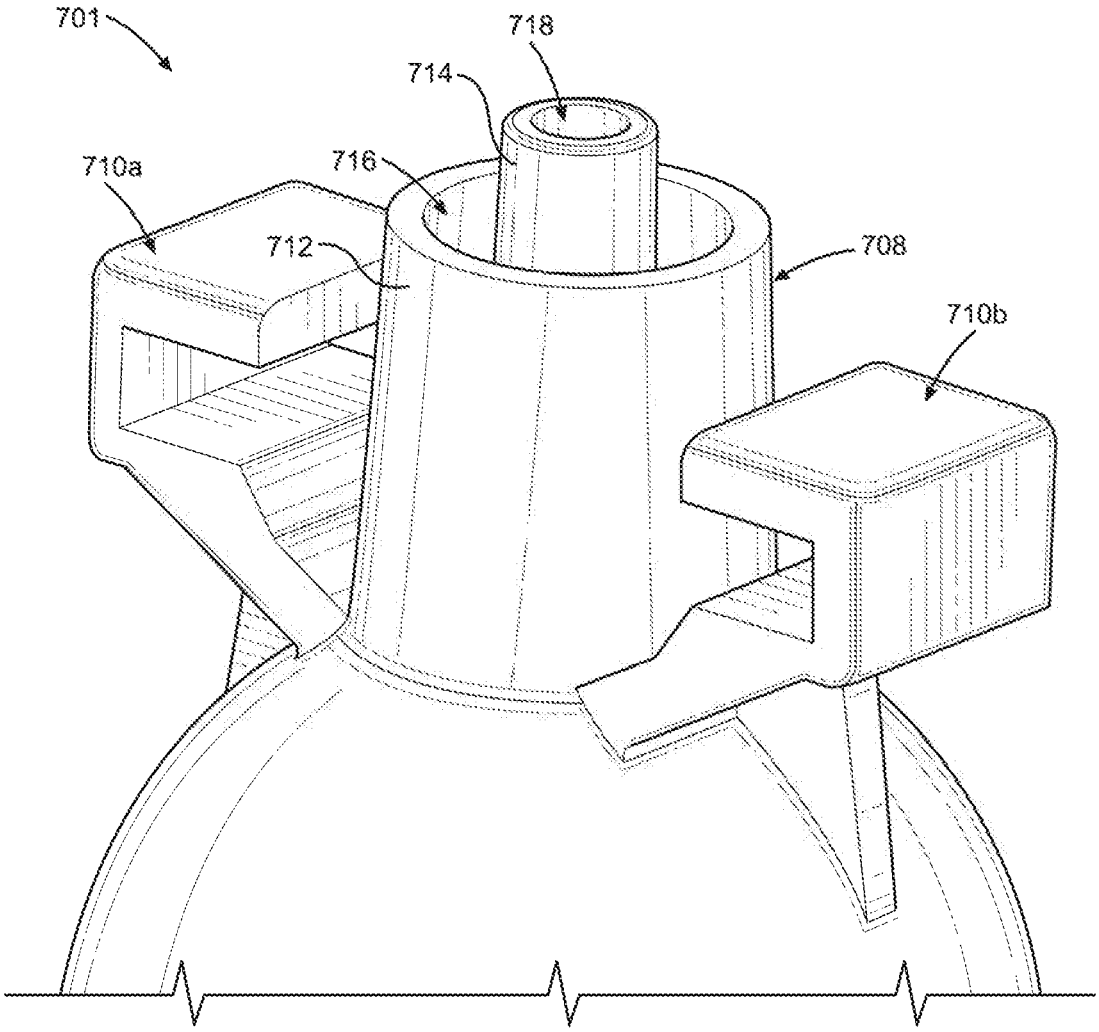
FIG. 11 illustrates a perspective view of a distal end of another alternate aspect of a fluid cartridge.

The outlet socket 708 of the fluid cartridge 701 is shown in further detail in FIG. 11. The outlet socket 708 includes a first flange 710*a* and a second flange 710*b*, a cartridge outlet annular wall 712, and a fluid outlet sealing wall 714. The cartridge outlet annular wall 712 and the fluid outlet sealing wall 714 extend distally from the distal end 704 of the fluid cartridge 701. The cartridge outlet annular wall 712 defines a hollow port 716 within, and substantially surrounds the fluid outlet sealing wall 714 such that the fluid outlet sealing wall 714 is positioned within the hollow port 716. The fluid outlet sealing wall 714 defines an outlet socket 718 that is in fluid communication with the fluid chamber 702. The fluid outlet sealing wall 714 includes a sealing surface that defines a luer taper. The cartridge outlet annular wall 712 is uninterrupted about the periphery of the hollow port 716.

Figure 12A:
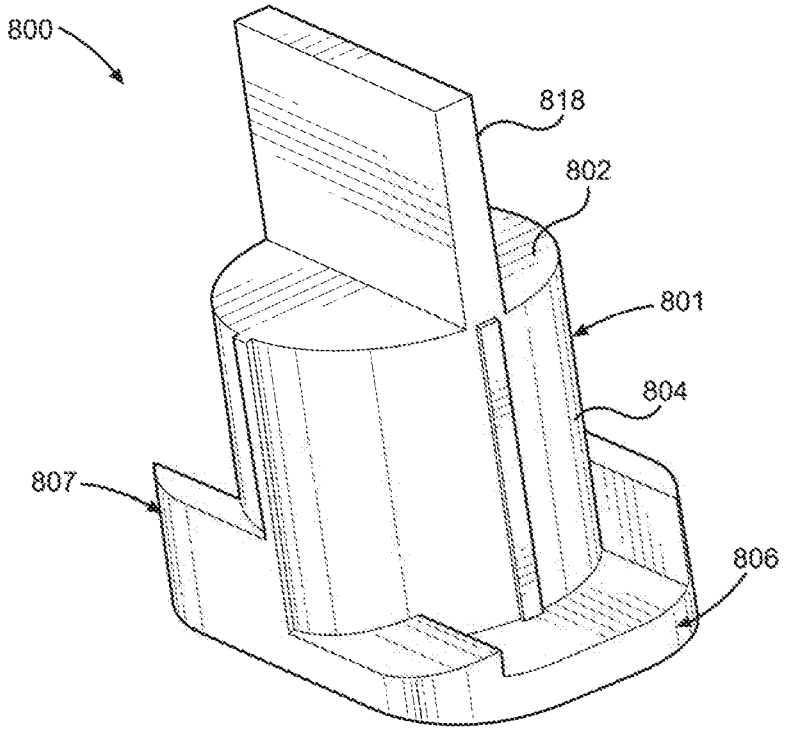
FIG. 12A illustrates a top perspective view of another alternate aspect of a sealing cap.
Figure 12B:
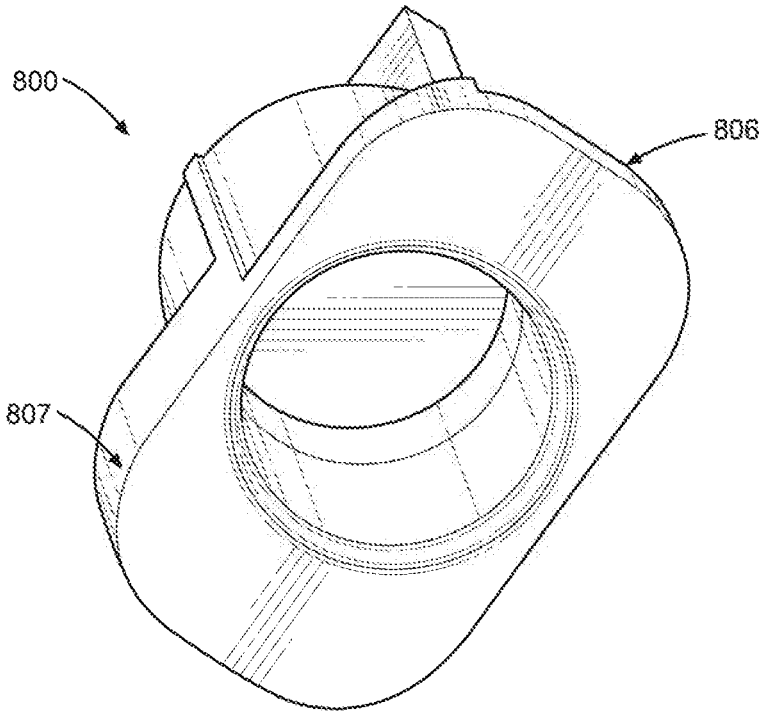
FIG. 12B illustrates a bottom perspective view of the sealing cap shown in FIG. 12A.

FIGS. 12A and 12B illustrate the sealing cap 800 configured to couple to the distal end 704 of the fluid cartridge 701, according to aspects of this disclosure. The sealing cap 800 includes a cap body 801. The cap body 801 includes a closed distal wall 802, a cap annular wall 804, a first retention member 806, a second retention member 807, and a handle 818 for gripping and rotating the cap body 801. The closed distal wall 802, the cap annular wall 804, the first retention member 806, and the handle 418 may be configured substantially similarly as the closed distal walls 202 and 402, the cap annular walls 204 and 404, the first retention members 206 and 406, and the handles 218 and 418 of the cap bodies 201 and 401, respectively, as described above. The second retention member 807 may be configured substantially similarly as the first retention member 806.

Figure 13:
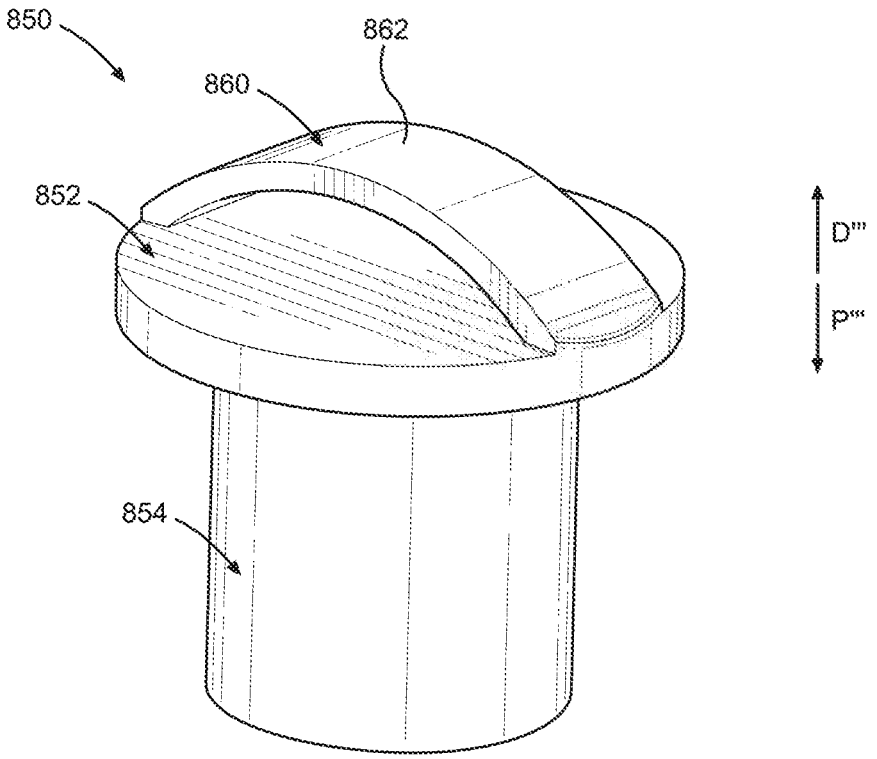
FIG. 13 illustrates a perspective view of another alternate aspect of a plug.
Figure 14:
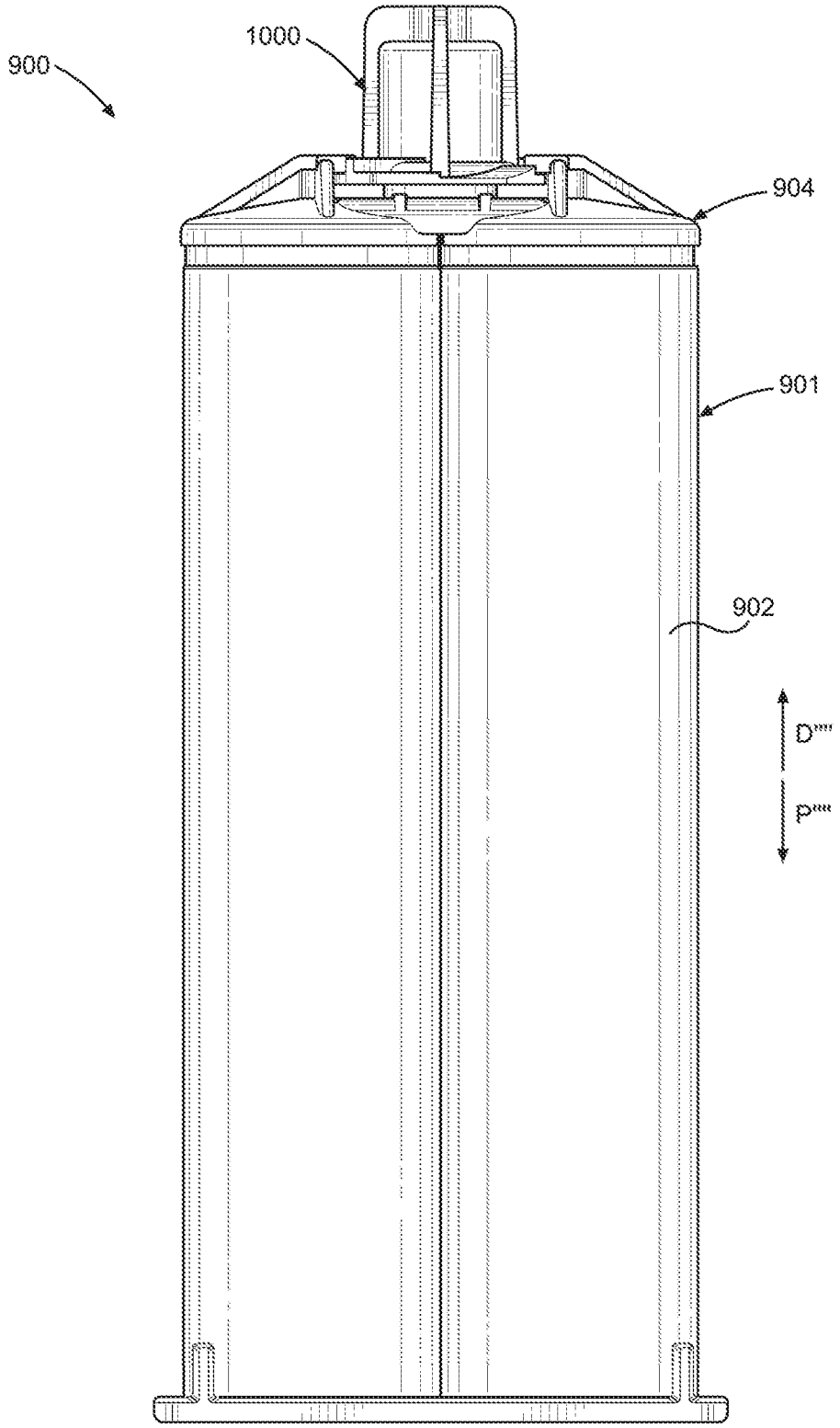
FIG. 14 illustrates a side view of another alternate aspect of a fluid cartridge assembly.
Figure 15:
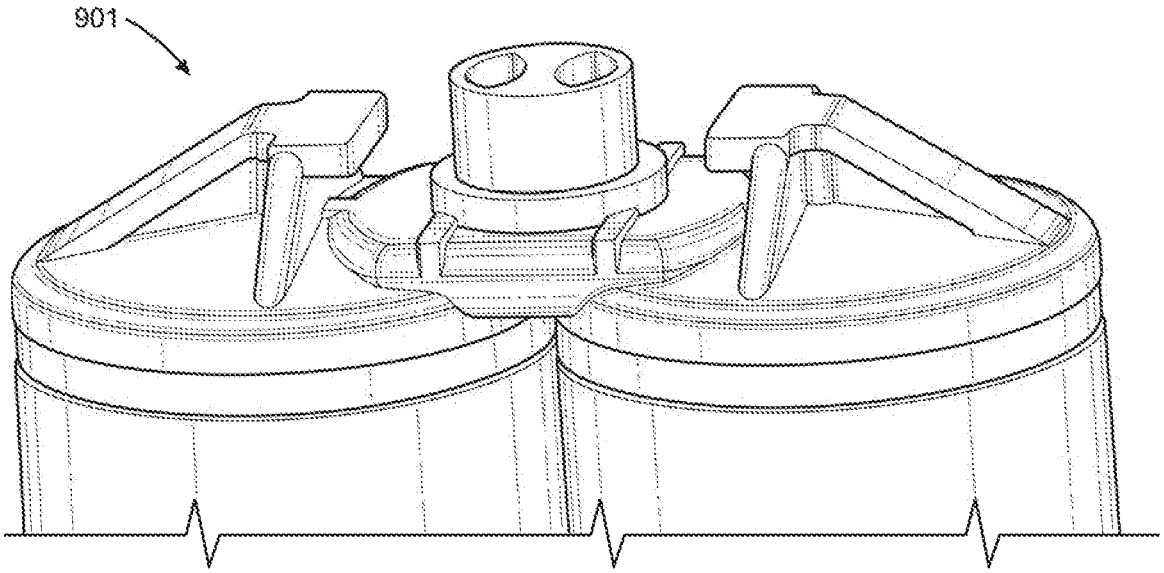
FIG. 15 illustrates a perspective view of a distal end of another alternate aspect of a fluid cartridge.

FIG. 13 illustrates a perspective view of a plug 850, according to an aspect of this disclosure. The sealing cap 800 includes the plug 850. The plug 850 is configured to be positioned at least partially within a channel of the cap body 801 formed by the cap annular wall 804. The plug 850 includes a plug wall 852 and plug member 854 that extends from the plug wall 852 in the proximal direction P'''. The plug member 854 is configured to be positioned within the cartridge outlet annular wall 712 extending from the fluid cartridge 701, such that the inner surface of the plug cap seals on the outer surface of the cartridge outlet, thus fluid flow through the outlet socket 718 from the fluid chamber 702 is substantially prevented. In an aspect, the plug member 854 forms substantially hollow cylindrical member.

The plug 850 further includes a biasing member 860. The biasing member 860 is formed on a distal side of the plug wall 852 such that the plug 850 and the biasing member 860 form a single component. The biasing member 860 includes resilient band 862. The resilient band 862 extends across the plug wall 852 and comprises a resilient material capable of recoiling or springing back into shape after bending, stretching, or being compressed. In an aspect, the biasing member 860 includes a single resilient spring arm 262. It will be appreciated, that fewer or more resilient spring arms 262 may compose the biasing member 260 based on the disclosure of this specification.

FIGS. 14 through 17 illustrate an alternate embodiment of a fluid cartridge assembly 900. Portions of the embodiment disclosed in FIGS. 14 through 17 are similar to aspects described above in FIGS. 1 through 13 and those portions function similarly to those described above. The fluid cartridge assembly 900 is a dual fluid cartridge assembly that includes a dual fluid cartridge 901 (e.g. 2 k cartridge) and a sealing cap 1000. In an aspect, the dual fluid cartridge 901 is a standard or commercial dual fluid cartridge that is currently produced and on the market. The dual fluid cartridge 901 is configured to contain two fluids to be dispensed and the sealing cap 1000 is configured to mate with the dual fluid cartridge 901 to seal the fluids within the fluid cartridge 901.

Figure 16A:
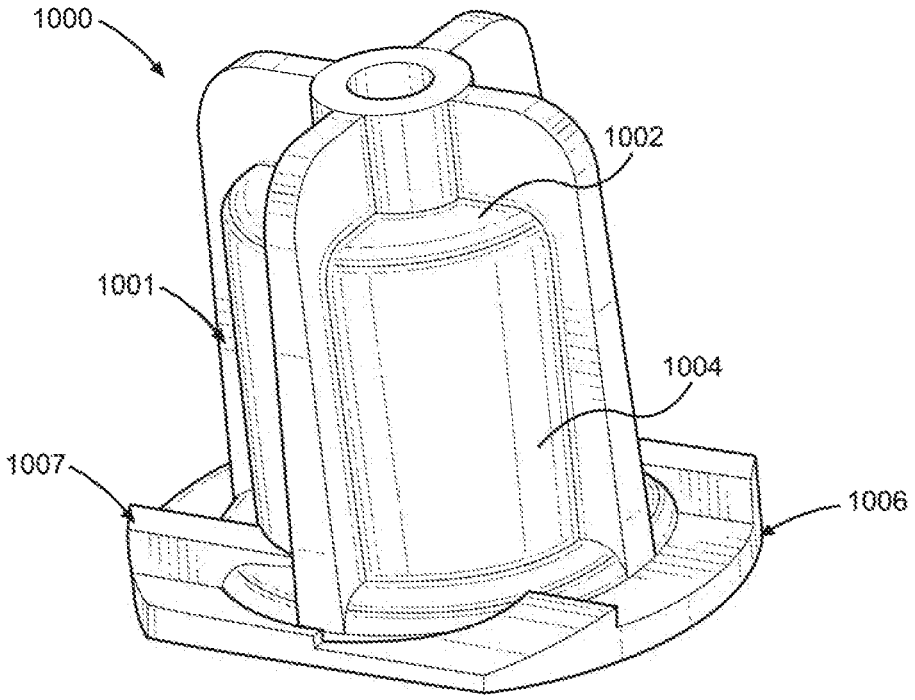
FIG. 16A illustrates a top perspective view of another alternate aspect of a sealing cap.
Figure 16B:
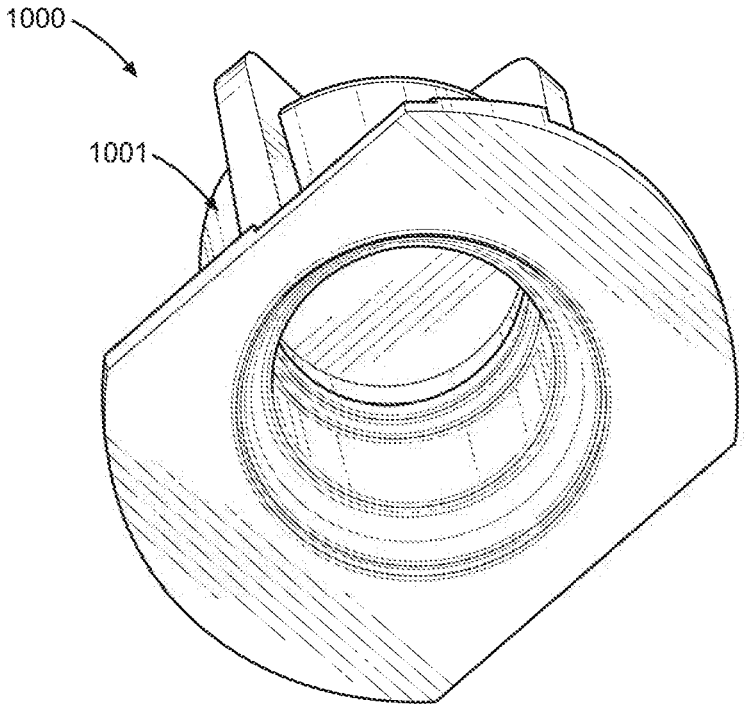
FIG. 16B illustrates a bottom perspective view of the sealing cap shown in FIG. 16A.

FIGS. 16A and 16B illustrate the sealing cap 1000 configured to couple to the distal end 904 of the fluid cartridge 901, according to aspects of this disclosure. The sealing cap 1000 includes a cap body 1001. The cap body 1001 includes a closed distal wall 1002, a cap annular wall 1004, a first retention member 1006, and a second retention member 1007. The closed distal wall 1002, the cap annular wall 1004, and the first retention member 1006 may be configured substantially similarly as the closed distal walls 202, 402, and 802, the cap annular walls 204, 404, and 804, and the first retention members 206, 406, and 806, of the cap bodies 201, 401, and 801, respectively, as described above. The second retention member 1007 may be configured substantially similarly as the first retention member 1006.

Figure 17:
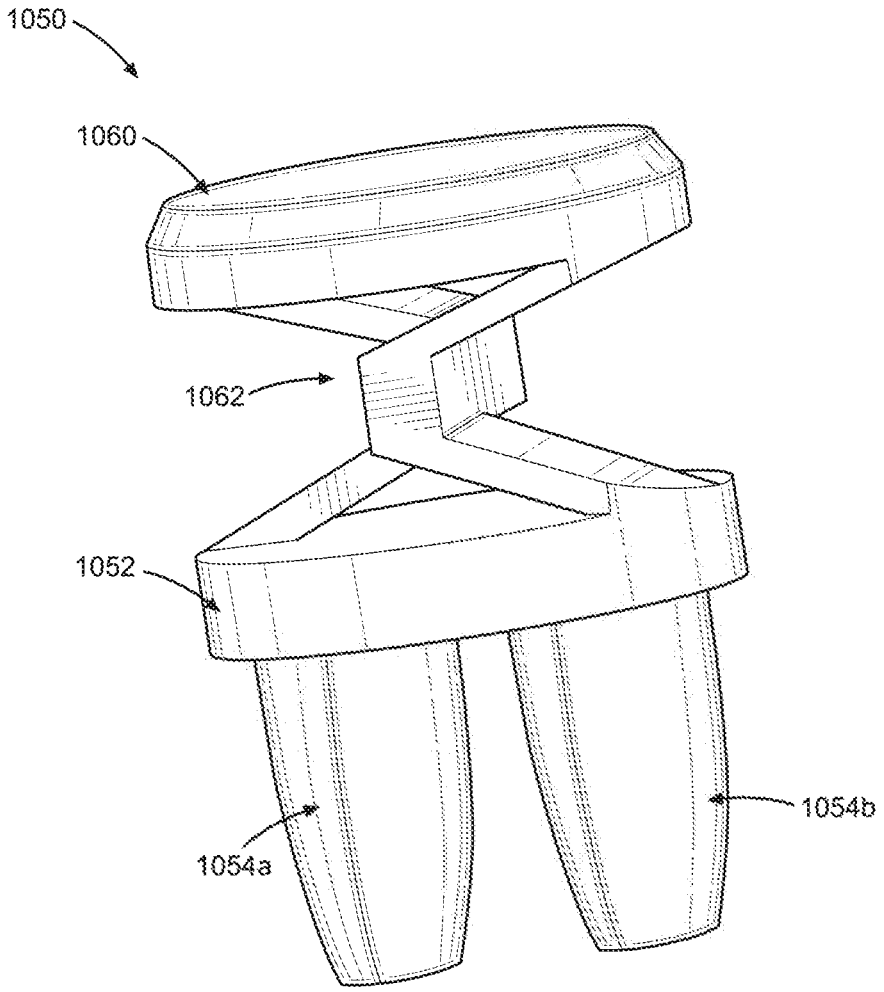
FIG. 17 illustrates a perspective view of another alternate aspect of a plug.

FIG. 17 illustrates a perspective view of a plug 1050, according to an aspect of this disclosure. The sealing cap 1000 includes the plug 1050. The plug 1050 is configured to be positioned at least partially within a channel 210 of the cap body 1001. The plug 1050 includes a plug wall 1052 and plug members 1054*a* and 1054*b* that extend from the plug wall 1052 in the proximal direction P'. The plug members 1054*a* and 1054*b* are configured to be positioned within cartridge outlets of the fluid cartridge 901, such that fluid flow through the cartridge outlets from fluid chambers 902 is substantially prevented.

The plug 1050 further includes a biasing member 1060. The biasing member 1060 is formed on a distal side of the plug wall 1052 such that the plug 1050 and the biasing member 1060 form a single component. The biasing member 1060 includes resilient spring arms 1062 in the form of an x-shape. The biasing member 1060 is configured to function substantially similarly as the biasing members 260, 460, and 860.

The precise appearance and structure defined by the fluid cartridges 101, 301, 501, 701, and 901 and sealing caps 200, 400, 600, 800, and 1000 may be modified without departing from the scope of the present disclosure. For example, elements described with respect to the fluid cartridge assemblies 100, 300, 500, 700, and 900 may be incorporated into one another.

One example of a method for using the fluid cartridge assembly 100 commences by attaching the sealing cap 200 to the fluid cartridge 101. The sealing cap 200 is attached to the fluid cartridge 101 by inserting the plug members 254*a* and 254*b* of the plug 250 into the cartridge outlets 116*a* and 116*b* of the fluid cartridge 101, respectively. As the plug 250 is being inserted, the alignment protrusion 208 of the sealing cap 200 is aligned with the alignment recess 118 of the fluid cartridge 101, maintaining alignment of the sealing cap 200 relative to the fluid cartridge 101.

After the plug members 254*a* and 254*b* are inserted into the cartridge outlets 116*a* and 116*b*, the cap body 201 is rotated such that the retention members 206 and 207 of the sealing cap 200 rotate relative to the flanges 110*a* and 110*b*. During rotation of the cap body 201, the first barb edge 220 engages the first flange 110*a*, which moves the cap body 201 towards the fluid cartridge 101. The cap body 201 continues to rotate until the stop 214 and/or the stop 230 contact an end of the flanges 110*a* and 110*b*, respectively. After rotation of the cap body 201 is complete, a biasing force provided by the biasing member 260 against the distal wall 202 of the cap body 201 moves each flange 110*a* and 110*b* into the first retention channel 226 and the second retention channel 238, respectively, securing the sealing cap 200 to the fluid cartridge 101. The plug 250 rotates relative to the cap body 201 during rotation of the cap body 201.

Prior to rotating the cap body 201 to secure the sealing cap 200 to the fluid cartridge 101 may be referred to as an "unlocked" position of the sealing cap 200. After the plug members 254*a* and 254*b* are inserted into the cartridge outlets 116*a* and 116*b* and during rotation of the cap body 201 until the stops 214 and 230 contact the respective flange 110*a* and 110*b*, may be referred to as a "released" position of the sealing cap 200. Once each flange 110*a* and 110*b* is positioned within the respective retention channel 226 and 238 may be referred to as a "locked" position of the sealing cap 200. When the sealing cap 200 is in the locked position, the risk of accidental removal (e.g. child access) of the sealing cap 200 from the fluid cartridge 101 is reduced. The retention members 206 and 207 of the sealing cap 200 and the flanges 110*a* and 110*b* of the fluid cartridge 101 act to make it more difficult for a child release the cap from the fluid cartridge. The retention members 206 and 207 and the flanges 110*a* and 110*b* also reduce the risk of accidental removal during, for example, shipping, handling, or other types of movement.

To remove the sealing cap 200 from the fluid cartridge 101, an operator may transition the sealing cap 200 from the locked position to the released position depressing the cap body 201 in the proximal direction P. Once the sealing cap 200 is in the released position, the cap body 201 is rotated until the retention members 206 and 207 are no longer in contact with the respective flange 110*a* and 110*b* (e.g. unlock position). Once the sealing cap 200 is in the unlock position, the sealing cap 200 may be removed by pulling the sealing cap 200 away from the fluid cartridge 101 in the distal direction D.

Although reference was made to the fluid cartridge assembly 100 in the above described example for using the fluid cartridge assembly 100, similar methods may also be employed by the fluid cartridge assemblies 300, 500, 700, and 900.

It will be appreciated that the foregoing description provides examples of the disclosed system and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

What is claimed is:

1. A cap for sealing a cartridge containing fluid, the cartridge including a cartridge body and a flange extending outwardly from the cartridge body, the cartridge body defining a cartridge outlet, the cap comprising:

a cap body including a cap wall and an annular wall extending from the cap wall in a proximal direction, the annular wall defining a channel within and including a retention member;

a plug positioned at least partially within the channel of the cap body, the plug being configured to substantially seal the cartridge outlet; and a biasing member configured to provide a biasing force to bias the cap wall in a distal direction opposite the proximal direction, wherein the cap is configured to rotatingly transition between a locked position and an unlocked position, wherein in the locked position the retention member is secured to the flange of the cartridge and the plug substantially seals the cartridge outlet, wherein the biasing force provided by the biasing member retains the cap in the locked position, and wherein in the unlocked position the retention member is not secured to the flange, wherein the cap includes at least one of the following features:

(a) the retention member includes a barb, a stop spaced apart from the barb, and a base extending circumferentially about the annular wall from the bard to the stop, wherein the barb, the stop, and the base define a retention channel and the flange is positioned within the retention channel when the cap is in the locked position;

(b) the retention member is disposed on an outer surface of the annular wall;

(c) the plug includes a plug wall extending substantially perpendicular to the proximal direction and a plug member extending from the plug wall in the proximal direction, wherein the biasing member is positioned between the plug wall and the cap wall and the biasing force biases the cap wall away from the plug wall; and/or (d) the biasing member is formed on a distal side of a plug wall of the plug such that the plug and the biasing member form a single component.

2. The cap of claim 1, wherein the cap is further configured to transition to a released position, wherein the cap transitions between the unlocked position and the released position by rotating the cap body relative to the cartridge body, and wherein the cap transitions from the released position to the locked position by moving the cap body in the distal direction relative to the cartridge body, wherein the biasing force provided by the biasing member biases the cap into the locked position from the released position.

3. The cap of claim 2, wherein, in the locked position, rotation of the cap body relative to the cartridge body is substantially prevented, wherein an unlock force applied to the cap body in the proximal direction transitions the cap from the locked position to the released position, wherein the unlock force is greater than the biasing force provided by the biasing member.

4. The cap of claim 1, wherein the cap includes at least feature (c) and the biasing member is formed on a proximal side of the cap wall such that the cap body and the biasing member form a single component.

5. The cap of claim 1, wherein the cap includes at least feature (c) and the biasing member comprises a spring.

6. The cap of claim 1, wherein the cap includes at least feature (c) and the cartridge outlet is a first cartridge outlet, the cartridge body further defining a second cartridge outlet, and wherein the plug member is a first plug member, the plug further including a second plug member extending from the plug wall in the proximal direction, wherein the first plug member is configured to substantially seal the first cartridge outlet, and the second plug member is configured to substantially seal the second cartridge outlet.

7. The cap of claim 1, wherein the biasing member is positioned between a proximal end of the annular wall of the cap body and a proximal end of the cartridge body.

8. A fluid cartridge assembly comprising:

a fluid cartridge comprising:

a cartridge body defining a cartridge outlet, and a flange extending outwardly from the cartridge body; and the cap of claim 1.

9. The fluid cartridge assembly of claim 8, wherein the cap is further configured to transition to a released position, wherein the cap transitions between the unlocked position and the released position by rotating the cap body relative to the cartridge body, and wherein the cap transitions from the released position to the locked position by moving the cap body in the distal direction relative to the cartridge body, wherein the biasing force provided by the biasing member biases the cap into the locked position from the released position.

10. The fluid cartridge assembly of claim 9, wherein, in the locked position, rotation of the cap body relative to the cartridge body is substantially prevented, wherein an unlock force applied to the cap body in the proximal direction transitions the cap from the locked position to the released position, wherein the unlock force is greater than the biasing force provided by the biasing member.

11. The fluid cartridge assembly of claim 8, wherein the plug includes a plug wall and a plug member extending from the plug wall in the proximal direction, wherein the cartridge outlet defined by the cartridge body is a first cartridge outlet, wherein the plug member of the plug is a first plug member, wherein the cartridge body further defines a second cartridge outlet, wherein the plug further includes a second plug member extending from the plug wall in the proximal direction, and wherein in the locked position the second plug member substantially seals the second cartridge outlet.

12. The fluid cartridge assembly of claim 8, wherein the biasing member is positioned between a proximal end of the annular wall of the cap body and a distal end of the cartridge body.

13. The fluid cartridge assembly of claim 12, wherein the biasing member is formed on a distal side of the cartridge body such that the cartridge body and the biasing member form a single component.

14. The fluid cartridge assembly of claim 12, wherein the biasing member is in direct contact with the proximal end of the annular wall when the cap is in the locked position.

15. The fluid cartridge assembly of claim 12, wherein the plug includes a plug wall and a plug member extending from the plug wall in the proximal direction, and wherein the biasing member is positioned between the plug wall and the cap wall.

16. The cap of claim 1, wherein the cap includes at least one of features (c) and (d) and the plug wall is configured to be slidable within the channel.

17. A cap for sealing a cartridge containing fluid, the cap comprising:

a cap body including a cap wall and an annular wall extending from the cap wall in a proximal direction, the annular wall defining a channel within, the annular wall including a retention member having a barb, a stop spaced apart from the barb, and a base extending circumferentially about a portion of the annular wall from the barb to the stop, wherein the barb, the stop, and the base define a retention channel;

a plug positioned at least partially within the channel of the cap body, the plug including a plug wall and a first plug member extending from the plug wall in the proximal direction and a second plug member extending from the plug wall in the proximal direction; and a biasing member positioned within the channel of the cap body between the plug wall and the cap wall, the biasing member being configured to provide a biasing force to bias the cap wall away from the plug wall.

18. The cap of claim 17, wherein the retention member is disposed on an outer surface of the annular wall.

19. The cap of claim 18, wherein the retention member is a first retention member, the annular wall further including a second retention member, the second retention member including a stop and a base extending circumferentially about a portion of the annular wall from the stop, the first retention member being adjacent to the second retention member in a circumferential direction.

20. The cap of claim 17, wherein the biasing member is formed on a distal side of the plug wall such that the plug and the biasing member form a single component.

21. The cap of claim 17, wherein the biasing member is formed on a proximal side of the cap wall such that the cap body and the biasing member form a single component.

22. The cap of claim 17, wherein the biasing member comprises a spring.

23. A cap for sealing a cartridge containing fluid, the cartridge including a cartridge body and a flange extending outwardly from the cartridge body, the cartridge body defining a first cartridge outlet and a second cartridge outlet, the cap comprising:

a cap body including a cap wall and an annular wall extending from the cap wall in a proximal direction, the annular wall defining a channel within and including a retention member;

a plug positioned at least partially within the channel of the cap body, the plug including a plug wall, a first plug member extending from the plug wall in the proximal direction and configured to substantially seal the first cartridge outlet, and a second plug member extending from the plug wall in the proximal direction and configured to substantially seal the second cartridge outlet; and a biasing member positioned between the plug wall and the cap wall and configured to provide a biasing force to bias the cap wall away from the plug wall in a distal direction opposite the proximal direction, wherein the cap is configured to rotatingly transition between a locked position and an unlocked position, wherein in the locked position the retention member is secured to the flange of the cartridge and the plug substantially seals the cartridge outlet, wherein the biasing force provided by the biasing member retains the cap in the locked position, and wherein in the unlocked position the retention member is not secured to the flange.

24. The cap of claim 23, wherein the retention member includes a barb, a stop spaced apart from the barb, and a base extending circumferentially about the annular wall from the barb to the stop, wherein the barb, the stop, and the base define a retention channel, wherein the flange is positioned within the retention channel when the cap is in the locked position.

25. The cap of claim 23, wherein the retention member is disposed on an outer surface of the annular wall.

26. The cap of claim 23, wherein the biasing member is formed on a distal side of the plug wall such that the plug and the biasing member form a single component.

* * * * *